United States Patent [19]

Rubel

[11] 4,286,487

[45] Sep. 1, 1981

[54] APPARATUS FOR MONITORING THE DELIVERY OF MATERIAL

[76] Inventor: Laurence P. Rubel, 600 Star St., Ocean Township, Monmouth County, N.J. 07712

[21] Appl. No.: 94,841

[22] Filed: Nov. 16, 1979

[51] Int. Cl.[3] ..... B26D 7/24

[52] U.S. Cl. ..... 83/58; 83/62; 83/63; 83/650; 242/55.3; 242/57

[58] Field of Search ..... 83/58, 62, 63, 650; 242/49, 57, 36, 47.08, 139, 85, 35.5 T, 55.3; 57/138; 706/394; 225/34–38, 46, 47

[56] References Cited

U.S. PATENT DOCUMENTS

| | | | |
|---|---|---|---|
| 41,239 | 1/1864 | Seymour | 83/650 |
| 187,271 | 2/1877 | Haight | 242/85 |
| 480,455 | 8/1892 | Eichhorn | 225/34 |
| 753,085 | 2/1904 | Maas et al. | 242/139 |
| 2,241,891 | 5/1941 | Sollie | 242/139 X |
| 2,512,200 | 6/1950 | Duncan | 242/55.3 |
| 3,337,158 | 8/1967 | Ball | 242/139 |
| 3,489,324 | 1/1970 | Stohl | 225/37 |
| 3,633,835 | 1/1972 | Beers | 242/57 X |
| 3,715,944 | 2/1973 | Knechtel et al. | 83/62 X |
| 3,845,323 | 10/1974 | Bellasio | 242/57 X |

*Primary Examiner*—Frank T. Yost
*Attorney, Agent, or Firm*—Leonard R. Fellen

[57] ABSTRACT

An apparatus for monitoring the delivery of material from a spool or the like to a machine which is to perform some work upon the material and draws the material from the spool. The apparatus includes a shaft for accommodating and fixedly securing the spool thereon, apparatus for positioning the shaft at a predetermined location wherein the positioning apparatus also permits the free rotation of the shaft about the longitudinal axis thereof, apparatus for providing a pulsed electrical signal upon rotation of the shaft, the pulsed electrical signal device having an element thereof directly coupled to the shaft for rotation as a result of the rotation of the shaft, and apparatus for indicating the output of the pulsed electrical signal device wherein the apparatus which does work on the material can be shut off if the material being fed from the spool becomes tangled, snarled, or otherwise jammed or is consumed.

7 Claims, 6 Drawing Figures

APPARATUS FOR MONITORING THE DELIVERY OF MATERIAL

BACKGROUND OF THE INVENTION

1. FIELD OF THE INVENTION

The present invention relates to devices for monitoring the unwinding of a length of material from a spool means, and more particularly to a monitoring apparatus wherein turning of a shaft means which mounts the spool means directly participates in the generation of a pulsed electrical signal for controlling a device for performing work on the length of material used in association with the monitoring apparatus.

2. DESCRIPTION OF THE CONTEMPORARY AND PRIOR ART

There are several different applications in the sewing industry where lengths of material must be delivered to automated equipment so that work can be done on the material or so that the material can be used as a part of a manufacturing or assembling operation. It is important that the supply of material be monitored so that damages in the material, knots, and material tangles as well as malfunctions which cause equipment to cease to demand material can be timely sensed so that equipment can be preferably automatically shut down without operator intervention. In addition, it is also desirable to provide for the shutdown of automated equipment when the material being fed to that equipment is consumed. Various apparatuses have been proposed in the prior art for accomplishing some or all of these either independently or together. However, apparatuses presently known tend to be expensive and have several drawbacks including frequent breakdowns attributable to contamination from dust, fibers, or chemicals used on the material which is being monitored. These problems arise primarily from contact between the sensing mechanisms of the monitors and/or the interaction between the material and the way the monitors sense the presence of material. Some limited function presently known devices for monitoring the delivery of material use mercury switches to test for the tension in the material or use photoelectric cells to sense the presence of material. However, these devices can only sense the presence or absence of material, not a jammed condition which is in most instances more important in terms of potential damage to machinery.

U.S. Pat. No. 3,177,749 issued to K. J. Best et al on Apr. 13, 1965 teaches a control for feeding, measuring, and cutting strip material wherein a wheel having a plurality of apertures disposed therethrough interrupts a light source which is focused on a light sensitive element. This counterwheel makes contact with the material passing through the apparatus through use of a pressure wheel which sandwiches the material between the pressure wheel and the counterwheel. As a result, material contact is not avoided and the attendant problems associated therewith are incurred. A perforated wheel which interrupts a light source shining on a light receptor hooked to an electronic counter is also shown in U.S. Pat. No. 3,550,493 issued to W. J. Benbenek on Dec. 29, 1970; U.S. Pat. No. 3,556,368 issued to P. L. Runde on Jan. 19, 1971; United E. H. Streckert on Dec. 17, 1969; U.S. Pat. No. 3,715,944 issued to W. J. Knechtel et al. on Feb. 13, 1973. Additionally, such a configuration is used by U.S. Pat. No. 3,170,667 issued to J. N. Kluger on December 14, 1970 to monitor the movement of a web. However, each and every one of these apparatuses depends upon contact between the material or web which is handled and either a counting wheel or an associated friction roller or the like to create a pulse.

The present invention overcomes, inter alia, the disadvantage of having a pulse forming mechanism frictionally engage the material which is to be monitored. This is accomplished through the direct coupling of an element of a pulsed electrical signal generation providing means with the rotating shaft which supplies a length of material wrapped around a spool means disposed on the shaft so that rotation imparted to the shaft by removal of the length of material from the spool means provides a pulsed electrical signal without contact with the material being monitored.

Unlike the above mentioned devices which simply count pulses (to determine length), the present device acts on pulses via a timing means. Time intervals between pulses are measured so that state of motion or no-motion can be determined.

SUMMARY OF THE INVENTION

Object of the present invention is to provide an apparatus for monitoring the delivery of material wherein material runout and snagging, jamming, malfunction of associated equipment or the like can be detected.

A further object of the present invention is to provide an apparatus for monitoring the delivery of material from a spool means which is not dependent upon gravity and which therefore can be used regardless of the orientation of the material to be monitored.

Still another object of the present invention is to provide an apparatus for monitoring delivery of material from a spool means wherein direct contact between the material to be monitored and the monitoring means is entirely avoided.

Another still further object of the present invention is to provide an apparatus for monitoring the delivery of material from a spool means which can shut off associated equipment when a predetermined condition is satisfied by the material which is monitored.

Still another object of the present invention is to provide an apparatus for monitoring the delivery of material from a spool means which can accommodate variously sized and dimensioned spool means without substantial variation of elements or modification of structure or assembly.

Still another object of the present invention is to provide an apparatus for monitoring the delivery of material from a spool means wherein the apparatus does not have to be adjusted or modified when different types of materials are monitored.

Still another object of the present invention is to provide an apparatus that will maintain the associated equipment in a safe off condition until manually reset by the equipment operator.

Another object of the present invention is to provide an apparatus for monitoring the delivery of material from a spool means which is simple in design, relatively inexpensive to manufacture, rugged in construction, and virtually maintenance free.

These objects, as well as further objects and advantages of the present invention, will become readily apparent after reading the ensuing description of the non-limiting embodiment and viewing the accompanying drawing.

An apparatus for monitoring the delivery of material from a spool means according to the principles of the present invention includes shaft means for accommodating and fixedly securing the spool means thereon, means for positioning the shaft means at a predetermined location relative to a supporting surface, the positioning means permitting the free rotation of the shaft means about the longitudinal axis thereof, means for providing a pulsed electrical signal upon rotation of said shaft means as a result of the drawing of material from said spool means, the pulsed electrical signal means having at least one element thereof directly coupled to the shaft means for rotation as a result of the rotation of the shaft means, and means for indicating the output of the pulsed electrical signal means.

BRIEF DESCRIPTION OF THE DRAWING

In order that the present invention may be more fully understood it will now be described, by way of example, with reference to the accompanying drawings in which.

DESCRIPTION OF THE PREFERRED EMBODIMENT

Figure 1:
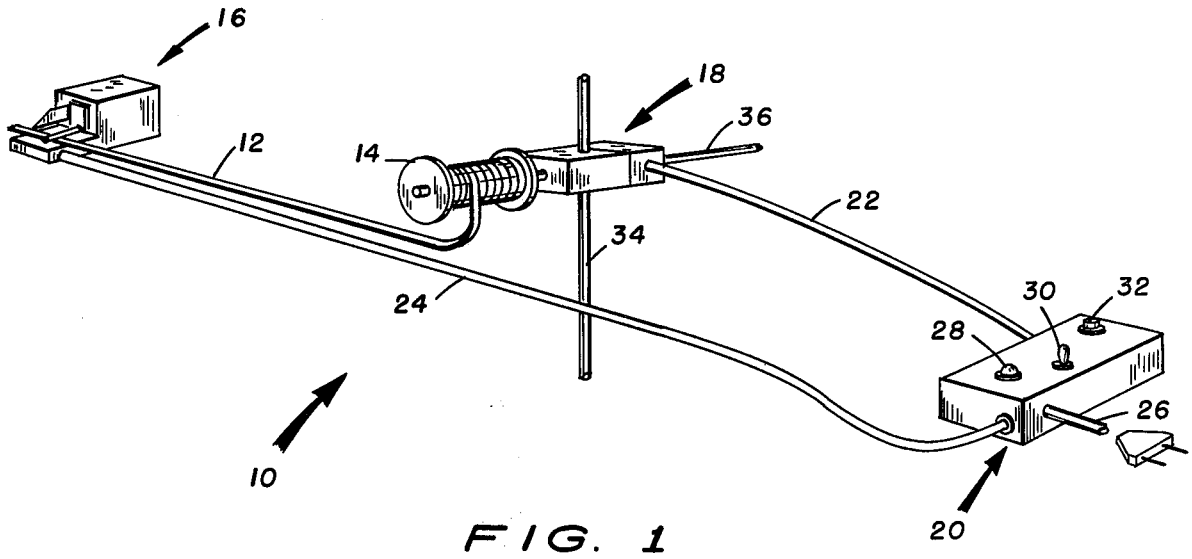
FIG. 1 is a perspective view of the present invention in use monitoring the delivery of a length of material to a strip cutting apparatus.

Referring now to the figures, and more particularly to FIG. 1 thereof, there is illustrated therein an apparatus 10 monitoring the delivery of a material 12 from a spool 14 to a strip cutting apparatus 16. Although the apparatus 10 is illustrated for use in conjunction with the strip cutting apparatus 16, it may be used for other types of equipment or machinery which require the delivery of a length of material or web.

The strip cutting apparatus 16 which has been selected for purposes of illustration is disclosed in U.S. Pat. No. 4,056,025 and has common inventorship with the present invention.

The apparatus 10 includes a spool mounting assembly 18 and a control box 20 connected together with a multiconductor electrical cable 22. The strip cutting apparatus 16 is provided power through a cable 24 that is connected to the control box 20 for delivery of electricity thereto as hereinafter described. Electricity is supplied to the control box 20 and therefore the spool mounting assembly 18 as well as the strip cutting apparatus 16 by a line cord 26. Control box 20 has mounted thereon a pilot light 28 and an on-off switch 30 connected to the line cord 26 in a conventional manner as illustrated in FIG. 5. In addition, a reset switch is mounted on the control box 20 which functions as hereinafter described. Also, there can be provided a knob to control sensitivity to match characteristics of machine being monitored. The control box 20 also serves as a housing for a substantial portion of the electronics of the present invention as will be described in conjunction with FIGS. 4, 5, and 6.

The spool mounting assembly 18 has a support 34 fixedly secured thereto to aid in positioning of the assembly 18. In addition, a rotating shaft 36 is provided by the spool mounting assembly 18 and serves to mount the spool 14. Although a particular size and shape spool 14 is illustrated, spools of various configurations and sizes can be mounted by the present invention as long as they permit delivery of material therefrom. As will be described in detail, the apparatus 10 essentially serves to monitor the feeding of material 12 to the strip cutting apparatus 16, or another machine of the user's choice, such that tangles, snags, knots or other problems which will preclude feeding of the material 12 to the apparatus 16 or consumption of the material 12 and subsequent emptying of the spool 14 will cause the apparatus 10 to cut off power both to the strip cutting apparatus 16 or the like and to the apparatus 10 until the condition is corrected and the reset button 32 is pressed by the user to restore the entire system to operation.

Figure 2:
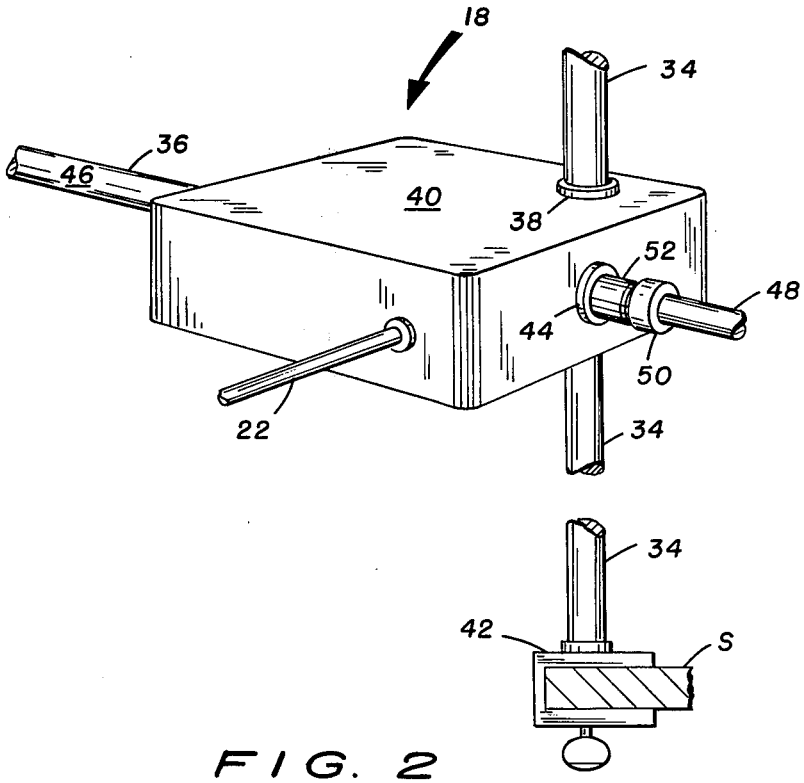
FIG. 2 is a perspective view of the spool means mounting portion of the present invention.

With reference to FIG. 2, the spool mounting assembly 18 is fixedly secured to the support 34 by at least one suitable fastener 38. The support 34 is illustrated as extending through the housing portion 40 of the spool mounting assembly 18 for rigidity, but other suitable arrangements can be employed so long as the housing portion 40 is rigidly secured to the support 34. A "C" clamp 42 is fixedly secured to an end of the support 34 and serves to clamp the support 34 and therefore the spool mounting assembly 18 to a supporting surface S. Typically, supporting surface S will be a machine table or the like. It should be apparent to one skilled in the art that other than a "C" clamp can be employed and that such substitute mounting for the "C" clamp 42 can be clamped to a supporting surface located in variously disposed planes.

The rotating shaft 36 provided by the spool mounting assembly 18 is disposed through a pair of aligned apertures located in the housing portion 40 and is supported by a pair of bearings 44 which permit free rotation of the shaft 36 about the longitudinal axis thereof. The shaft 36 is further supported as will be subsequently described. In order to accommodate spools having different internal diameters, a first section 46 of the shaft 36 is of one diameter and a second removable section 48 of the shaft 36 is of a second diameter. The second section 48 is removably secured to the first section 46 by a threaded coupling 50 fixedly secured to the second section 48 and which threadably cooperates with a threaded portion 52 adjacent to one end of the first section 46 of the rotatable shaft 36. The second section 48 can be engaged or disengaged from the first section 46 as desired. Similarly, other schemes or configurations can be employed for attaching different diameter shafts or other mounting structures for a spool.

Figure 3:
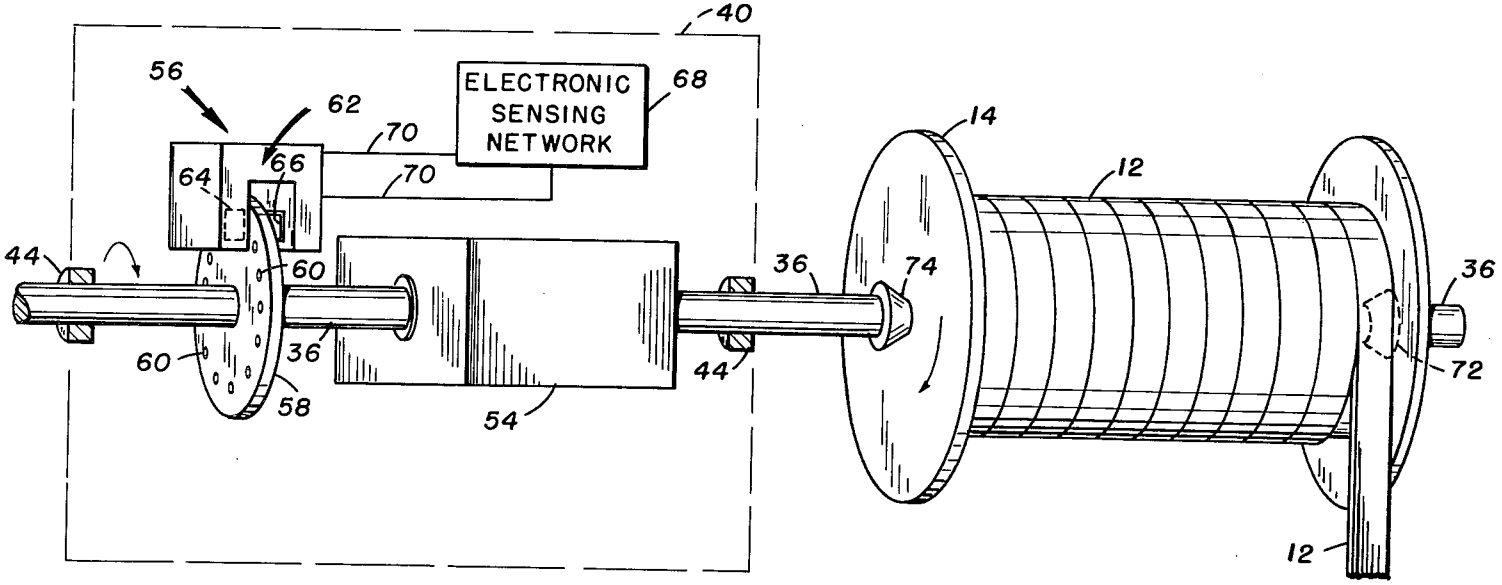
FIG. 3 is a pictorial representation of the interior of the housing of the present invention.

Considering FIG. 3 along with FIG. 2, it can be seen that the rotating shaft 36 is additionally supported by a ball bearing assembly 54 fixedly secured to the housing portion 40 of the spool mounting assembly 18. The ball bearing assembly is a sealed unit but other suitable bearing assemblies can be employed. The exact bearing assembly which is used and the bearings or journals which are employed where the rotating shaft extends through the housing portion are unimportant so long as the rotating shaft 36 is fixed into position and can support the weight of the spool 14 and simultaneously is freewheeling so that it can rotate about the longitudinal axis thereof. A pulse generator 56 has a disk portion 58 thereof fixedly secured to the shaft 36. The disk 58 has a plurality of apertures 60 disposed therethrough which are arranged in a circular pattern. The disk 58 is straddled by a horseshoe shaped assembly 62 which serves to mount a light source 64 such as a photodiode or similarly functioning component and a light receptor 66 such as a photo-transistor or the like.

The light source 64 is positioned within the assembly 62 so that it is directed at the light receptor 66 and the assembly 62 is fixedly secured to the housing portion 40 of the spool mounting assembly 18 so that the assembly 62 is positioned in such a manner as to permit the apertures 60 disposed in the disk 58 to permit light to shine from the light source 64 on the light receptor 66 and for this light to be interrupted upon rotation of the disk 58 as a result of the rotation of the rotating shaft 36. The light source 64 and the light receptor 66 are operably connected to an electronic sensing network 68 which will hereinafter be fully described in conjunction with FIGS. 4, 5, and 6. The electronic sensing network 68 may be disposed entirely within the housing portion 40 or some of the components thereof can be disposed within the control box 20 illustrated in FIG. 1. The provision of a separate housing poriton 40 and a control box 20 is one of convenience so that the on-off switch 30 and the reset switch 32 can be located in a position remote to that of the housing portion 40, but this provision is not essential to the invention and other housing configurations can be used as determined by one skilled in the art.

The spool 14 which is illustrated in FIG. 3 is an arbitrary shape and may vary accordingly to different needs. Likewise, the material 12 is also shown in arbitrary dimensions and may be of various widths and cross-sectional dimensions and shapes as required. The common relationship between the spool 14 and the material 12 is that the material 12 is wound therearound for delivery therefrom. The spool 14 can be secured to the rotating shaft 36 in many manners by variously configured latches, clamps, etcetera and is illustrated as being held in position on the shaft 36 by a pair of conical clamps 72 which each serve the purpose of engaging the end panels of the spool 14. Each of the clamps 72 also provide a locking screw 74 to fix the position of the clamps 72 on the shaft 36. As the material 12 is drawn from the spool 14, the shaft 36 is urged into free rotation and the pulse generator 56 is urged into action without any contact between the pulse generator 56 and the material 12 so that the material 12 does not need to be abused in any manner whatsoever nor is it in any way subjected to detrimental contact that inevitably results from friction type material monitors.

Figure 4:
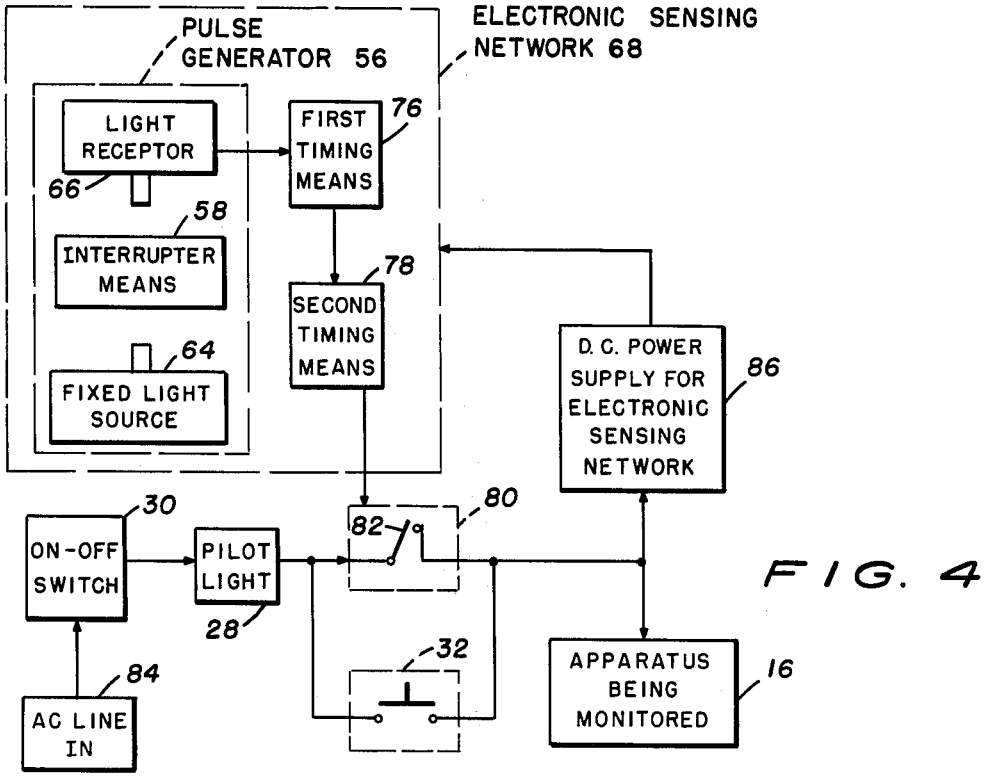
FIG. 4 is a block diagram of the electronic sensing network of the present invention.
Figure 5:
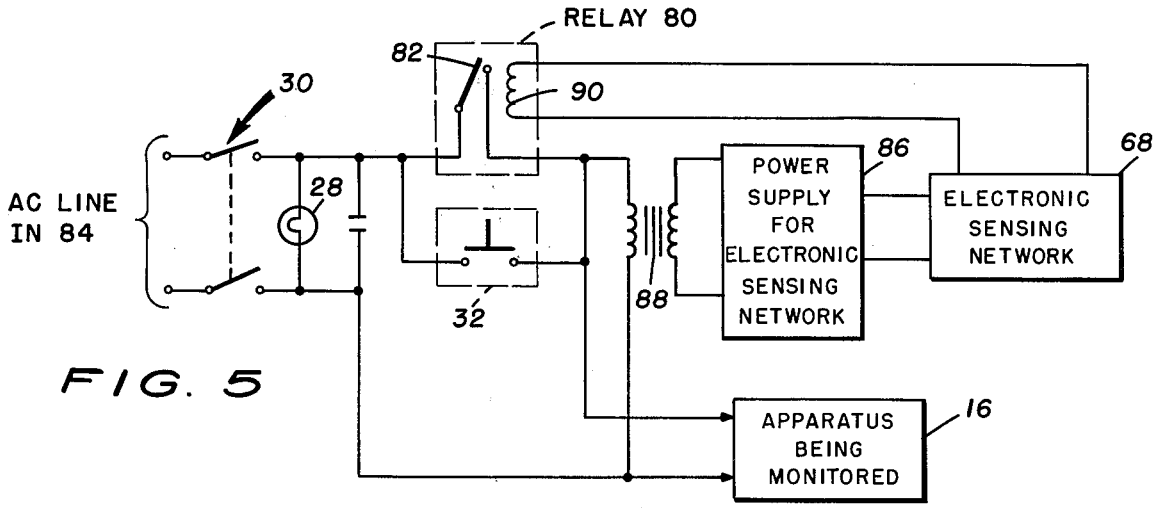
FIG. 5 is a block diagram of the manner in which the electronic sensing network of the present invention is connected to a machine being monitored by the present invention.

The pulse generated by the pulse generator 56 is utilized to monitor the delivery of the material 12 from the spool 14 as a result of the circuitry illustrated in FIG. 4. The fixed light source 64 and the light receptor 66 are schematically illustrated with an interruptor means embodied by the disk 58 disposed therebetween. The output of the pulse generator 56 is in the form of a pulsed electrical signal and is coupled to a first timing means 76. The output of the first timing means 76 is coupled to the input of a second timing means 78 and the output of the second timing means 78 is coupled to a preferably solid state relay. The output of the first timing means 76 provides an electrical signal at a first level for a finite time when the rotating shaft 36 rotates as a result of the disk 58 interrupting the beam of light between the fixed light source 64 and the light receptor 66. When the rotating shaft 36 rotates at a speed below a preselected minimum or if it is at rest, the first timing means 76 provides an output at a second level. The output of the first timing means 76 returns to the second level after the finite interval. This finite interval can be predetermined to be less than or equal to the minimum time required for one of the apertures 60 to pass through the light beam formed by the fixed light source 64 until the next aperture 60 appears in the same position when the shaft 36 is rotating at its minimum desired speed as correlated with the demand of the apparatus 16.

The previously described output of the first timing means 76 is fed to the second timing means 78 which provides a signal at the output thereof if the signal of the first timing means 76 is not received by the second timing means 78 at a preselected interval. When the second timing means 78 provides a signal at the output thereof, it is fed to the relay 80 to open the contacts 82 thereof. A preselected interval of no signal in after which an output signal is provided by the second timing means 78 may be fixed or variable depending upon the needs of the apparatus or machine 16. Since the machine 16 being monitored might well operate at different speeds, this interval prior to shut off can be adjustable using suitable electronic circuitry well known in the art. The relay 80 may be normally open or normally closed depending upon the exact manner in which the electronic sensing network 68 is to control the machine or apparatus 16.

The A.C. power line 84 is fed past the power switch 30 and the pilot light 28, wired in a conventional manner, to the contacts of the relay 80 and the reset switch 32 which is in parallel with the relay contacts 82. The relay contacts 82 are in series with the A.C. line in 84 and feed both the power supply 86 for the electronic sensing network and the apparatus 16. Therefore, when the second timing means 78 causes the relay 80 to open the contacts thereof, power to the machine or apparatus and the power supply 86 and therefore the electronic sensing network 68 are killed. This would happen if the disk 58 slows down in rotation beyond the preselected speed of if the disk 58 stops in any position relative to the light from the fixed light source 64 shining on the light receptor 66. The reset switch 32 is provided to bypass the relay contacts 82 so that once the electronic sensing network 68 and the apparatus 16 are shut down and the problem which caused the shutdown is cured, the system can be started up again simply by pressing of the reset switch 32. With this configuration, apparatus 16 can not falsely operate until the operator uses reset switch 32.

The manner in which the apparatus being monitored 16 and the electronic sensing network 68 are provided with the line current 84 is illustrated in the wiring diagram of FIG. 5. The on-off switch 30 breaks both sides of the A.C. line in 84. When the switch 30 is closed, the pilot light 28 which is across the switch 30 is activated. One side of the A.C. line 84 is then fed to one of the relay contacts 82 and to one side of the reset switch 32. The other side of the A.C. line is fed to the apparatus 16 and one side of the primary winding of a transformer 88. When the relay contacts 82 are in a closed position or when the reset switch 32 is closed, the first side of the A.C. line is then fed to the other side of the primary winding of the transformer and to the apparatus 16. The secondary of the transformer 88 is connected to the power supply 86 for the electronic sensing network. The electronic sensing network 68 controls the coil 90 of the relay 80, or the electronic equivalent thereof, so that the function previously described can be implemented.

Figure 6:
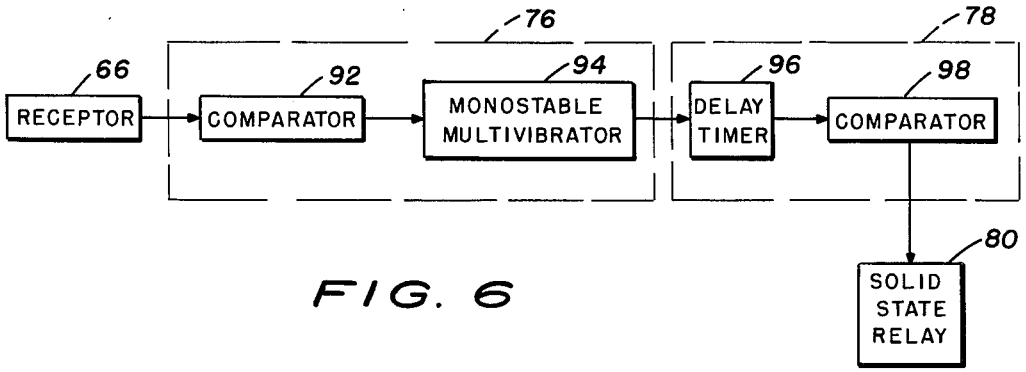
FIG. 6 is a block diagram of the timing means of the electronic sensing network of the present invention.

It should be apparent to one skilled in the art that the electronic sensing network 68 and the pulse generator 56 thereof can be variously configured. The first and second timing means 76 and 78 can take many forms and can easily be placed on a single IC chip. A possible configuration for this chip or otherwise implemented circuit is illustrated in FIG. 6. The first timing means 76 is seen to comprise a comparator 92 which is coupled to a monostable multivibrator 94, the comparator 92 being fed by the receptor 66. The second timing means 78 is fed by the first timing means 76 and comprises a delay timer 96 and a comparator 98. The delay timer 96 feeds the comparator 98 which in turn feeds the solid state relay 80 so that the desired control functions relating to the apparatus 16 being monitored can be accomplished. Other timing means aside from those illustrated can be employed in conjunction with a pulse generator configured as pulse generator 56 or otherwise, the essential feature being that an element of the pulse generator, in this case, the disk 58 acting as an interruptor means is directly coupled to rotation of the rotating shaft 36. For instance, a magnet and inductor system could be substituted for the pulse generator 56 or any other device which translates rotation of the shaft 36 into pulses. Similarly, the first and second timing means 76 and 78 are meant to be merely illustrative of one way that the pulses provided by a pulse generator cooperating with the rotation of the shaft 36 can be properly interpreted within preselected design constraints to operate relay 80 and therefore control operation of the apparatus 16. Substitutions or modifications in the pulse generator 56 and the first and second timing means 76 and 78 are within the scope of the present invention.

It will be understood that various changes in the details, materials, arrangements of parts and operational conditions which have been herein described and illustrated in order to explain the nature of the invention may be made by those skilled in the art within the principles and scope of the invention.

Having thus set forth the nature of the invention, what is claimed is:

1. A monitoring apparatus for monitoring the unwinding of a length of material from a spool means as said material is drawn therefrom comprising:

shaft means for accommodating and fixedly securing said spool means thereon;

means for positioning said shaft means at a predetermined location relative to a supporting surface, said positioning means permitting the free rotation of said shaft means about the longitudinal axis thereof;

means for providing a pulsed electrical signal upon rotation of said shaft means, said pulsed electrical signal means having at least one element thereof directly coupled to said shaft means for rotation as a result of the rotation of said shaft means;

means for indicating the output of said electrical signal means;

said indicating means includes a two stage timing means, the input of the first stage of said timing means being coupled to the output of said pulsed electrical signal means, the output of said first stage of said timing means being coupled to the input of said second stage of said timing means, the output of said first stage of said timing means providing an electrical signal at a first level for a finite interval when said shaft means rotates through a minimum angle, said first stage of said timing means providing at the output thereof an electrical signal at a second level after said finite interval when said shaft means rotates at a speed below a minimum preselected speed or if said shaft means stops, said second stage of said timing means providing a signal at the output thereof if said signal of said first stage at said first level is not received thereby at a preselected interval.

2. A monitoring apparatus in accordance with claim 1, further comprising switching means coupled to said output of said second stage of said timing means, said switching means changing condition upon receipt of said signal at said output of said second stage of said timing means, said switching means adapted to shut off power to an electrical apparatus.

3. A monitoring apparatus in accordance with claim 2, wherein said electrical apparatus performs work on said material and pulls the same from said spool means continuously when said electrical apparatus is in an operating mode.

4. A monitoring apparatus in accordance with claim 2, wherein said switching means simultaneously shuts off power to said pulsed electrical signal means and said indicating means upon said shut off of power to said electrical apparatus.

5. A monitoring apparatus in accordance with claim 4, further comprising means for manual re-energizing said switching means to reactivate said pulsed electrical signal means, said indicating means, and said electrical apparatus, thus reactivating said switching means.

6. A monitoring apparatus in accordance with claim 1, wherein said first stage of said timing means comprises a first comparator operably coupled to a monostable multivibrator and said second stage of said timing means comprises a delay timer operably coupled to a second comparator.

7. An apparatus for monitoring the unwinding of a length of material from a spool means as said material is drawn therefrom comprising:

shaft means for accommodating and fixedly securing said spool means thereon, said shaft means comprising a rod dimensioned for insertion through said spool means and at least one clamp for fixedly securing said spool means to said rod;

means for positioning said shaft means at a predetermined location relative to a supporting surface, said positioning means permitting the free rotation of said shaft about the longitudinal axis thereof, said positioning means comprising a housing, a suitable bearing assembly rotatably affixing said shaft means to said housing, a support being fixedly secured to said housing, said support for securing said housing to said supporting surface;

means for providing a pulsed electrical signal upon rotation of said shaft means, said pulsed electrical means having at least one element thereof directly coupled to said shaft means for rotation as a result of the rotation of said shaft means, said pulsed electrical signal means comprising a disk fixedly secured to said shaft means, said disk having a plurality of apertures disposed therethrough and arranged so that each of said apertures passes through a preselected location upon rotation of said disk, light source means providing a beam of light directed through said apertures when each of said apertures are disposed at said preselected location, and light receptor means positioned to receive said light beam, said disk being disposed intermediate said light source and said receptor means, said light receptor means providing a pulsed electrical output as a result of the rotation of said shaft means and therefore said disk;

control network means for receiving the output of said pulsed electrical signal means, said control network means comprising a two stage timing means, the input of the first stage of said timing means being coupled to the output of said pulsed electrical signal means, the output of said first stage of said timing means being coupled to the input of said second stage of said timing means, the output of said first stage of said timing means providing an electrical signal at a first level for a finite time when said shaft means rotates. Said first stage of said timing means providing at the output thereof an electrical signal at a second level when said shaft means rotates at a speed below said minimum preselected speed or if said shaft means stops, said output of said first stage of said timing means returning to said second level after said finite interval, said second stage of said timing means providing a signal at the output thereof if said signal of said first stage at said first level is not received thereby at a preselected interval; and switching means coupled to said output of said second stage of said timing means, said switching means changing condition upon receipt of said signal at said output of said second stage of said timing means, said switching means adapted to shut off power to an electrical apparatus performing work on said material, said electrical apparatus pulling said material from said spool means when said electrical apparatus is in an operating mode, said switching means simultaneously shutting off power to said electronic control means and to said electrical apparatus means; and means being provided for manually resetting said switching means to reactivate said control network means and said electrical apparatus.

* * * * *